US006221491B1

(12) United States Patent
Kavesh et al.

(10) Patent No.: US 6,221,491 B1
(45) Date of Patent: Apr. 24, 2001

(54) HEXAGONAL FILAMENT ARTICLES AND METHODS FOR MAKING THE SAME

(75) Inventors: Sheldon Kavesh, Whippany; Alexander Lobovsky, New Providence, both of NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/516,370

(22) Filed: Mar. 1, 2000

(51) Int. Cl.[7] ..... D01F 6/00
(52) U.S. Cl. ..... 428/397; 428/364; 428/370
(58) Field of Search ..... 428/397, 364, 428/370

(56) References Cited

U.S. PATENT DOCUMENTS

| | | | | |
|---|---|---|---|---|
| 3,762,364 | * | 10/1973 | Funsch | 118/33 |
| 3,767,756 | | 10/1973 | Blades | 264/184 |
| 4,136,221 | * | 1/1979 | Okamoto et al. | 428/91 |
| 4,340,559 | | 7/1982 | Yang | 264/181 |
| 4,413,110 | | 11/1983 | Kavesh et al. | 526/348 |
| 4,440,711 | | 4/1984 | Kwon et al. | 264/185 |
| 4,466,935 | | 8/1984 | Bair et al. | 264/184 |
| 4,522,873 | * | 6/1985 | Akagi et al. | 428/283 |
| 4,551,296 | | 11/1985 | Kavesh et al. | 264/177 |
| 4,555,421 | * | 11/1985 | Yasue | 428/6 |
| 4,599,267 | | 7/1986 | Kwon et al. | 428/364 |
| 5,286,833 | | 2/1994 | Bubeck et al. | 528/183 |
| 5,618,909 | | 4/1997 | Lofquist et al. | 528/310 |
| 5,702,657 | | 12/1997 | Yoshida et al. | 264/112 |
| 5,946,447 | | 8/1999 | Nakagawa et al. | 386/95 |

OTHER PUBLICATIONS

J. Text. Inst., Yarn–on–Yarn Abrasion Testing of Rope Yarns, Part I: The Test Method, 1988, No. 3, pp. 417–431.

* cited by examiner

*Primary Examiner*—N. Edwards
(74) *Attorney, Agent, or Firm*—Virginia S. Andrews; Melanie L. Brown; Roger H. Criss

(57) ABSTRACT

The present invention is related to a multi-filament article comprising filaments having a substantially hexagonal cross-section and a method for making the same. The filaments are formed by spinning a melt or solution of a polymer through a capillary spinneret having an orifice with a centrally disposed, generally circular, center cavity portion with six side cavity portions projecting radially away from the center cavity portion.

7 Claims, 2 Drawing Sheets

HEXAGONAL FILAMENT ARTICLES AND METHODS FOR MAKING THE SAME

BACKGROUND OF THE INVENTION

The shape of a textile filament can impart very specialized properties to a multi-filament strand. For example, a multi-filament strand constructed from a plurality of filaments having various polygonal cross-sections has deer-skin or suede-like properties. Further, a multi-lobed filament with the distal ends slightly curved in a uniform direction has resilience or resistance to matting. Thus, the properties imparted by a given textile filament shape may be quite distinctive.

Conventional multi-filament articles such as yarns, tows, threads, twines and ropes are made from filaments having essentially round cross-sections. These articles have voids between the filaments due to the essentially round filament cross-sections. It is an object of the present invention to create a novel synthetic filament having a cross-section such that, when combined with other like filaments, it creates a more densely packed multi-filament article in cross-section. The resulting multi-filament article will have a smaller diameter but retain the tensile strength equivalent to the conventional multi-filament article having a larger diameter but essentially the same multi-filament cross-sectional area.

Another object of the present invention is to provide a multi-filament article with improved distribution of tension such that the multi-filament article experiences lower stress when flexed as compared to a multi-filament article comprised of conventional round filaments, the two articles having essentially equivalent filament cross-sectional areas. This improved distribution of tension with concomitant lower flexure stress provides a multi-filament article characterized by longer useful life due to its combined flexure and abrasion resistance.

It is a further object of the present invention to provide a spinneret and die/orifice that can form a filament that is substantially hexagonal in cross-section. Such a filament has six longitudinal, substantially planar faces (or facets) capable of abutting the substantially planar faces (or facets) of six other like filaments across essentially each entire face for the entire length of the filaments.

SUMMARY OF THE INVENTION

The present invention relates to filament having a space-filling cross-sectional area and to the multi-filament articles made therefrom. More particularly, the invention relates to filament that is substantially hexagonal in cross-section and to multi-filament articles made from same and characterized by improved properties. The filaments of the present invention can be formed into multi-filament yarns, tows, threads, twines and ropes with increased tensile strength per unit cross-sectional area compared to conventional multi-filament articles formed from round filaments. Since the filaments have a space-filling cross-section in the aggregate, the multi-filament article has a more compact cross-sectional area; as a consequence the article is thinner than conventional prior art multi-filament articles.

Accordingly, the present invention includes a multi-filament article comprising a plurality of filaments formed from filament-forming material, arranged to extend longitudinally. The filaments are formed with a generally hexagonal cross-section having substantially planar faces (or facets) extending along the longitudinal axis, where the filaments are arranged with adjacent filaments having adjacent faces (or facets) in abutment with one another substantially along the length of the multi-filament article. In the context of this invention the term "substantially planar faces or facets" may include some concavity or some convexity of the faces/facets so long as the depth of a circular segment defining the concavity or convexity, in proportion to a side of the hexagon, is less than about 0.06 (6%).

Further, the present invention includes methods for producing a multi-filament article, said multi-filament article being formed from a plurality of generally longitudinally-aligned filaments, each said filament being formed with a generally hexagonal cross-section along its length. A first method comprises the steps of forming a melt of a filament-forming material; placing the melt in communication with a spinneret, said spinneret defining multiple orifices (or dies) wherein each orifice has a centrally disposed, generally circular, center cavity portion, with six side cavity portions projecting radially away from said center cavity portion; extruding said melt through said orifices of said spinneret to form a multi-filament melt stream; and cooling to solidify said multi-filament melt stream to form a multi-filament yarn, each filament of said yarn having a generally hexagonal cross-sectional area and six substantially planar faces/facets extending longitudinally along said filament.

A second method for producing a multi-filament article comprises the steps of forming a solution of a filament-forming material; placing the solution in communication with a spinneret, said spinneret defining multiple orifices (or dies) wherein each orifice has a centrally disposed generally circular center cavity portion, with six side cavity portions projecting radially away from said center cavity portion; extruding said solution through said orifices of said spinneret to form a multi-filament solution stream; solidifying, washing, and drying said multi-filament solution stream to form a multi-filament yarn, each filament of said yarn having a generally hexagonal cross-sectional area and six substantially planar faces or facets extending longitudinally along said filament.

The present invention also includes a novel orifice or die geometry in a spinneret comprising a centrally disposed generally circular center cavity portion, with six side cavity portions projecting radially away from said center cavity portion wherein the six side cavities have ends and wherein at least a portion of the ends are a constant width.

The present invention includes as the filament-forming material any suitable polymeric material, including without limitation the polyamides, polyaramides, polybenzazoles, polycarbonamides, polyolefins, polyethers, polyketones, vinyl polymers, polyesters, and co-polymers and blends of the aforementioned.

DETAILED DESCRIPTION OF THE INVENTION

Figure 1A:
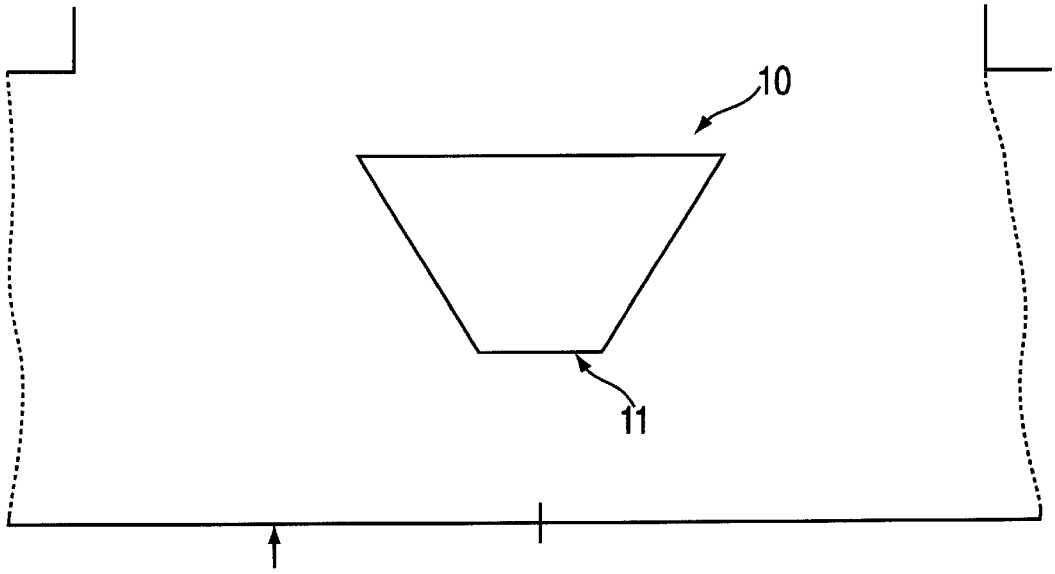
FIG. 1(*a*) is a cross-sectional view of a spinneret in accordance with the present invention, and FIG. 1(*b*) is an end view of the spinneret in accordance with the present invention showing the shape of the orifice or die in the spinneret.

The present invention includes a multi-filament article that is made from a plurality of filaments with generally regular polygonal cross-sections and a method for producing the multi-filament article. As used herein, "multi-filament article" includes, but is not limited to, a bundle of filaments, a bundle of fibers, ropes, cords, yarns, tows and the like. For the individual filaments, the generally planar faces, or facets, of the polygons extend along the length of the filament. In a preferred embodiment of the present invention, the polygons are regular hexagons. Further, in a preferred embodiment, the cross-section of a single filament is substantially constant over the entire length of the filament.

In the multi-filament article, the individual filaments are arranged with adjacent faces in abutment with one another substantially along a portion of their respective lengths, and preferably substantially along the entirety of their respective lengths. Consequently, the multi-filament article has a reduced diameter cross-section, due to a reduction in interstitial void space between filaments, when compared with a multi-filament article of equivalent filament cross-sectional area but made from a plurality of round (or other cross-sectional shape) filaments. This space-filling arrangement creates a multi-filament article having a similar tensile strength but reduced diameter when compared with a conventional multi-filament article made from round filaments.

The outer filaments of the multi-filament article of the present invention will experience lower stresses when the multi-filament article is flexed as compared to one made with round filaments. Additionally, filaments of the present invention allow for distribution of lateral stresses over a broader area of each filament when the multi-filament article is under tension. These factors sustain longer use for multi-filament articles of the present invention as compared to prior art multi-filament articles made from round (or other cross-sectional shape) filaments.

As used herein, "filament-forming material" refers to natural or synthetic polymers of sufficient molecular weight to be spun into filaments by conventional melt spinning or solution spinning techniques. Polymers capable of being formed into fibers via solid state rolling and stretching are also deemed to be "filament-forming material". Conventional solution spinning techniques are described in U.S. Pat. Nos. 3,767,756; 4,340,559; 4,466,935; 4,413,110; 4,440,711; 4,551,296; 4,599,267; 5,286,833 and 5,946,447, herein incorporated by reference. Conventional melt spinning techniques are described in U.S. Pat. No. 5,618,909 and the patents listed therein, herein incorporated by reference. Conventional solid state rolling and stretching techniques are described in U.S. Pat. No. 5,702,657 and the patents listed therein, herein incorporated by reference.

The nature of the polymer can vary widely, and any polymer known for use in forming filaments can be used. Illustrative of such polymers are polyethylene, polypropylene, polyvinyl alcohol, polystyrene, polyvinyl chloride, polyvinyl fluoride, polyvinylene fluoride, polyacrylamide, polyacrylonitrile, polyvinyl pyridine, polyvinyl acetate, polyacrylic acid, polyvinyl pyrrolidine, polyvinyl methyl ether, polyvinyl formal, poly (P-vinyl phenol), polyester, polyamide, polybenzoxazole, polybenzothiazole and the like.

The polymer may be any of a variety of conventional thermoplastics used in filament production which are of filament forming molecular weight. The meaning of this term is well known in the art. By way of example, for polyamides [e.g., nylon 6, nylon 66] and polyaramides [e.g., KEVLAR® aramid (available from DuPont Corp.)], a filament-forming molecular weight generally means a number average molecular weight of at least 10,000. In the case of polymers such as polyethylene, polyacrylonitrile and polyvinyl alcohol, a filament-forming molecular weight is usually a number average molecular weight of at least about 2,000, and in the case of polyesters (such as polyethylene terephthalate), a filament-forming molecular weight is usually a number average molecular weight of at least about 10,000.

The polyamide for use in the most preferred embodiments of this invention is polycaprolactam which is commercially available from Honeywell International Inc. under the trademark CAPRON®.

The preferred polyester is selected from the group consisting of poly(ethylene terephthalate), poly(butylene terephthalate), and poly(1,4-cyclohexane dimethylene terephthalate). Among these polyesters of choice, poly (ethylene terephthalate) is most preferred.

The spinning apparatus used in the practice of this invention may vary widely and the extrusion step of the process may be performed in a conventional extrusion apparatus for spinning ordinary filaments of the same polymer. When the spinning apparatus is fitted with a spinneret having spinning dies or orifices in accordance with the present invention, filaments having a substantially hexagonal cross-section are formed. Thus, for example, in the melt spinning of polyethylene terephthalate filaments, ordinary powder or pellet feed systems and extruders may be used, as described in "Encyclopedia of Polymer Science and Technology," Vol. 8 pp. 326–381, herein incorporated by reference in its entirety. The spinning apparatus may have a plurality of spinnerets for spinning several filaments simultaneously.

The orifice or orifices of the spinneret are shaped such that the extruded material acquires planar faces, or facets, after passing through the orifice and being solidified. The number and orientation of the faces should be such that the cross-section of the extruded filament forms a regular polygon. In the preferred embodiment, the polygon is a regular hexagon.

Figure 1B:
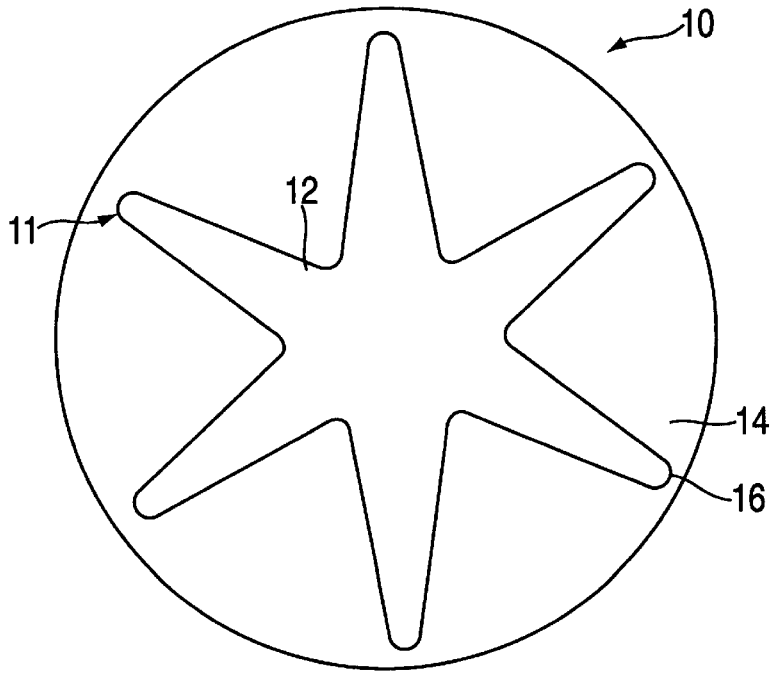

With reference now to FIGS. 1*a* and 1*b*, a spinneret 10 in accordance with the present invention is shown. The hexagonal cross-section of the filament is formed by extruding the filament-forming material through an orifice 11 having a centrally disposed, generally circular, center cavity portion 12, with six substantially identical side cavity portions 14 projecting radially away from the center cavity portion 12. The diameter of the central cavity 12 may be from about 0.127 to about 0.762 mm (0.005 to 0.030 inch), and in a preferred embodiment, about 0.330 mm (0.013 inch) in diameter. The overall effective diameter from the tip 16 of one side cavity 14 to the tip of an opposite side cavity may be from about 0.381 to about 3.048 mm (0.015 to 0.120 inch), and in a preferred embodiment, about 1.0668 mm (0.042 inch) in diameter. The tip 16 of each side cavity 14 may have a width of about 0.0381 to about 0.127 mm (0.0015 to 0.005 inch), and in a preferred embodiment, about 0.0559 mm (0.0022 inch). The side cavities 14, where they join the central cavity, may be formed by radius less than about 0.127 mm (0.005 inch) and in a preferred embodiment, about 0.0445 mm (0.00175 inch).

The tip 16 of the side cavities maintain a constant width of the tip 16 for about 0 to about 0.508 mm (0 to 0.020 inch) from the end of the tip, and in a preferred embodiment, about 0.1016 mm (0.004 inch) until each side cavity widens in a uniform manner to join the central cavity. The orifice length in the direction of flow may be from about 0.254 mm to about 3.048 mm (0.010 to 0.120 inch), and in a preferred embodiment, about 1.27 mm (0.050 inch).

A first embodiment of the method for producing the multi-filament article of the present invention, in which the multi-filament article is formed from a plurality of generally longitudinally aligned filaments, with each filament being formed with a hexagonal cross-section, comprises the steps of:

(a) forming a melt of a filament-forming material;

(b) placing the melt in communication with a spinneret, said spinneret defining multiple orifices wherein each orifice has a centrally disposed, generally circular, center cavity portion, with six side cavity portions projecting radially away from said center cavity portion;

(c) extruding said melt through said orifices of said spinneret to form a multi-filament melt stream; and (d) cooling to solidify said multi-filament melt stream to form a multi-filament yarn, each filament of said yarn having a generally hexagonal cross-sectional area and six substantially planar faces, or facets, extending longitudinally along said filament.

In a preferred embodiment, the orifices of the spinneret are shaped as previously described and shown in FIGS. 1*a* and 1*b*. In this embodiment, the melt stream issuing from the spinneret is preferably passed through a heated sleeve and then cooled by passing through stagnant air at a temperature of less than about 30° C. After cooling, the multi-filament yarn is preferably transferred to a succession of heated driven rollers where it is stretched in a conventional manner to produce a highly oriented multi-filament yarn and wherein each filament maintains its substantially hexagonal shape in cross-section.

A second method for producing the multi-filament article of the present invention, comprises the steps of:

(a) forming a solution of a filament-forming material;

(b) placing the solution in communication with a spinneret, said spinneret defining multiple orifices wherein each orifice has a centrally disposed, generally circular, center cavity portion, with six side cavity portions projecting radially away from said center cavity portion;

(c) extruding said solution through said orifices of said spinneret to form a multi-filament solution stream;

(d) solidifying;

(e) washing; and (f) drying said multi-filament solution stream to form a multi-filament yarn, each filament of said yarn having a generally hexagonal cross-sectional area and six substantially planar facets extending longitudinally along said filament.

In the context of this invention, the terms "solidify" and "solidifying" refer to a change from a fluid melt or solution to a glassy, rubbery or partially crystalline state, caused either by a change in temperature or by coagulation by a non-solvent.

As prepared by either embodiment, the individual filaments have an equivalent diameter between about 0.01 mm and 0.06 mm and in a preferred embodiment, about 0.024 mm. The equivalent diameter of a hexagonal filament is equal to the diameter of a round filament having the same denier. The yarn prepared by either of the embodiments may be further processed by conventional fiber processes such as twisting, knitting and plying, and may be formed into threads, twines, ropes and other articles.

It will be recognized that a melt filament or a solution filament issuing from an orifice of the spinneret is a dynamic body acting under the influences of surface tension, visco-elastic stresses and thermal/and or mass fluxes. Accordingly, the shape of the filament changes along the path from the orifice to the point of solidification. The shape of the spinneret orifice governs the initial state of that evolution and defines all accessible filament shapes. However, if the skilled man finds that the final filament shape is not precisely as desired, he will know that the point of solidification and therefore the final shape of the solidified filaments may be adjusted by changing the initial conditions at the spinneret as well as the conditions along the spin line. Well known factors under the control of the skilled operator include the initial temperature and/or concentration of the filament, the mass rate of flow, the take-up velocity and the temperature/non-solvent concentration along the spin line.

The following examples are presented to more particularly illustrate the invention and are not to be construed as limitations thereon.

EXAMPLE 1

Yarn Preparation

Polyethylene terepthalate (PET) of 0.94 dl/g intrinsic viscosity (measured in a mixture of 60% wt phenol and 40% tricholorethylene at 25° C.) was fed to a single screw extruder of 1.90 cm diameter at the rate of 30 g/min. The extruder zone temperatures were set at 295° C. The molten PET was conveyed to a spin pump and delivered at a rate of approximately 3.8 lb/hr and a temperature of 304° C. through a screen pack to a 25-orifice spinneret. Each orifice of the spinneret was shaped as shown in FIGS. 1*a* and 1*b*. The molten filaments issuing from the spinneret were passed through a heated sleeve, about 30 cm in length, whose surface temperature was approximately 340° C. The filaments were cooled and solidified by passage through a stagnant air column at approximately 30° C., passed over a spin finish applicator, and conveyed to a first driven roll operating at 278 m/min surface speed and at room temperature.

From the first driven roll, the 25-filament yarn was conveyed to a second driven roll at a temperature of 95° C. and running at a surface speed of 287 m/min. The yarn was then passed over a heated surface at a temperature of approximately 193° C. and conveyed to a third driven roll at a temperature of 155° C. and running at a surface speed of 1594 m/min. From the third driven roll, the yarn passed to a fourth driven roll operating at room temperature and at a surface speed of 1537 m/min, and was then taken up on a winder.

Figure 2A:
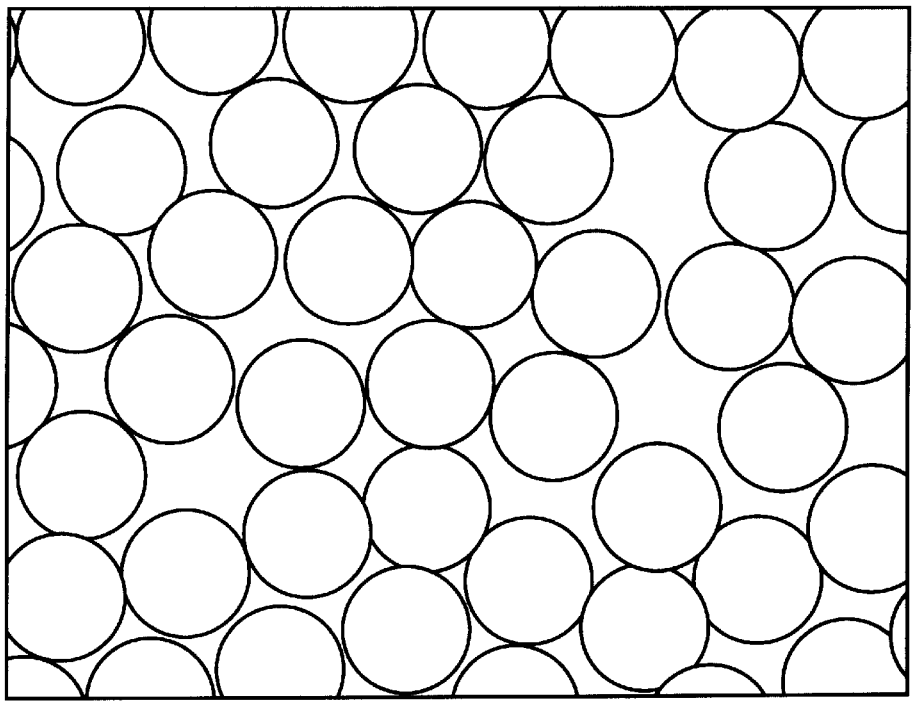
FIG. 2(*a*) is a cross-sectional view of a prior art multi-filament yarn of round filament cross-sections, and FIG. 2(*b*) is a cross-sectional view of a multi-filament article of hexagonal filament cross-sections, in accordance with the present invention.
Figure 2B:
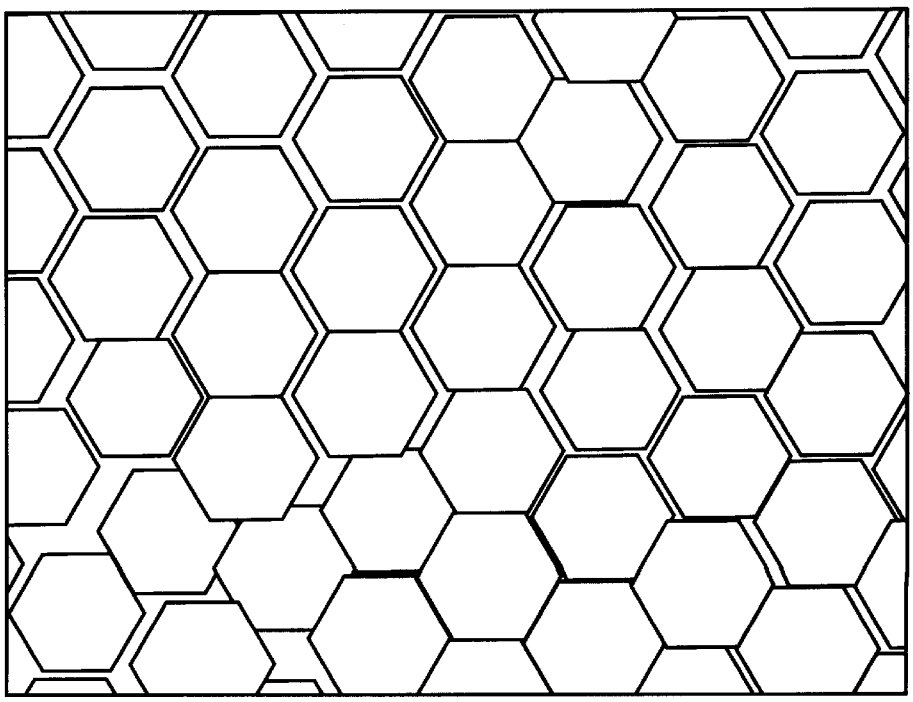

The cross-sections of the filaments comprising the yarn prepared according to the method described in Example 1 were substantially hexagonal in shape as shown in FIG. 2*b*. It is evident from FIG. 2*b* that the hexagonal filaments of the present invention are capable of filling space more efficiently than prior art round filaments spun under essentially the same conditions and depicted in FIG. 2*a*.

EXAMPLE 2

Properties of the Yarn

The tensile properties of the 25-filament yarn (173–174 total denier) prepared according to the method described in Example 1 were: tenacity 6.94 (+/−0.15) g/d; modulus 149 (+/−12) g/d; and % ultimate elongation 10.8 (+/−0.8) (as measured by ASTM D2256, herein incorporated by reference in its entirety). Comparative 25-filament yarns formed from round fibers spun under essentially the same conditions were: tenacity 7.11 (+/−0.26) g/d; modulus 139 (+/−5) g/d; and % ultimate elongation 11.5 (+/−0.9).

The 25-filament yarns were rewound and combined. This was accomplished by rewinding rolls of 25-filament yarns onto six separate cores, followed by combining the ends of the six 25-filament yarns and rewinding, to give 150-filament yarns. The tensile properties of this 150-filament (all hexagonal in cross-section) yarn (1030 denier) were: tenacity 5.63 (+/−0.40); modulus 128(+/−6.1); and % ultimate elongation 8.4 (+/−1.1) (as measured by ASTM D2256, herein incorporated by reference in its entirety). The tensile properties of the comparative 150-filament yarn formed from round fibers (1046 denier) were: tenacity 6.34 (+/−0.36) g/d; modulus 132 (+/−5.6) g/d; and % ultimate elongation 9.6 (+/−1.1)

The coefficients of friction (COF) of the hexagonal filament yarn, measured using a Rothschild Friction Meter by the method of ASTM D3412, were: yarn-on-yarn COF 0.011 and yarn on metal COF 0.662. Comparative multi-filament yarn formed from round cross-sectional filaments produced a yarn-on-yarn COF of 0.014 and a yarn on metal COF of 0.630. Thus, the yarn of the present invention had a 22% lower yarn-on-yarn COF than the comparable round cross-sectional filament yarn.

EXAMPLE 3

Buckling Fatigue Characteristics

Measurements of resistance to buckling fatigue were made by the method described in the report "Fiber Tethers 2000, high Technology fibers for Deepwater Tethers and Mooring" Report N. L17317/NDE/RWPS, Consultants, Tension Technology International Ltd., 22 Warsalp Avenue, Arbroath, Angus, DD11 2DG, Scotland, Feb. 10, 1995, herein incorporated by reference in its entirety. In this method a multi-filament yarn was held between two clamps, one fixed and one subject to reciprocating motion. At the maximum gap between the two clamps, the multi-filament yarn was in a neutral state as it was neither in compression nor tension. At the minimum gap, the multi-filament yarn experienced compressive buckling. Multi-filament yarns comprised of nine ends of the 150-filament yarns described above were subjected to a buckling amplitude of 1.78 mm (3.88 mm maximum gap, 2.10 mm minimum gap) and a buckling strain of 45.9%. The multi-filament yarn was cycled at a rate of 8 Hz though two million buckling cycles. The multi-filament yarn formed from hexagonal filaments of the present invention retained 56.8% of its tensile strength. A comparative multi-filament yarn formed from round filaments retained 57.0% of its tensile strength.

EXAMPLE 4

Abrasion Resistance Characteristics

Measurements of yarn-to-metal abrasion resistance were made in accordance with of Federal Motor Vehicle Safety Standard 209, herein incorporated by reference in its entirety, modified as follows. The multi-filament yarn to be tested was clamped at one end and subjected to a reciprocating motion in a horizontal direction over a distance of 32 cm at a frequency of 0.5 Hz. A given weight was suspended from the other end of the multi-filament yarn. The multi-filament yarn passed over a hexagonal steel bar of ¼" (0.635 cm) dimension/diameter, point to point, between the two ends. As the yarn passed over the bar, the direction of the yarn was changed from horizontal to vertical. The multi-filament yarn bore against two edges of the hexagonal bar. At the completion of a given number of cycles of reciprocating motion, the multi-filament yarn was detached from the apparatus and its residual tensile strength was determined. The multi-filament yarn formed from hexagonal filaments made in accordance with Example 1 showed a 99.1% (n=8) residual tensile strength after 2500 cycles with 100 g load and a retention of 85% (n=8) residual tensile strength after 5000 cycles with a 400 g load. Comparative multi-filament yarn formed from round filaments showed a 97.3% (n=10) residual tensile strength after 2500 cycles with 100 g load and a retention of 79% (n=10) residual tensile strength after 5000 cycles with a 400 g load. The results for a multi-filament yarn formed from hexagonal filaments showed a greater resistance to hex bar abrasion than for a comparable multi-filament yarn formed from round filaments. It is theorized that the stresses between the filaments and the bar are distributed over a larger area for a hexagonal filament than for a round filament, and this lower stress translates into lower wear.

Measurements were also made of yarn-on-yarn abrasion resistance by the draft test method entitled "Standard Test Method for Wet and Dry Yarn-on-Yarn Abrasion Resistance", $4^{th}$ draft submitted to the American Society for Testing Methods, Oct. 28, 1998 and described by J. F. Flory, M. Goksoy and J. W. S. Hearle, *J. Text. Inst.,* 3, 417–431 (1988) herein incorporated by reference. Three wraps of a multi-filament yarn were wrapped around itself in a defined geometry. The multi-filament yarn was reciprocated back and forth across itself under a specified load and speed until the multi-filament yarn failed. The number of cycles to failure for the multi-filament yarn formed with fibers of hexagonal cross-section was measured to be an average of 24,249 (12,092–47,102) n=16 at 200 g load (dry). Comparative multi-filament yarns formed from round fibers showed an average of 23,373 (17,062–25,901; n=12) cycles to failure.

The multi-filament yarn formed from hexagonal filaments showed a much broader range of favorable results than comparable prior art multi-filament yarns formed from round filaments. One fourth of the tests showed the multi-filament yarn formed from hexagonal filaments to have nearly twice the number of cycles to failure as the comparable prior art multi-filament yarns formed from round filaments.

EXAMPLE 5

Rope Properties

Three strand ropes were prepared from the 150 filament yarns prepared in Example 2. One rope was composed of the hexagonal filaments of the invention. The other rope was composed of the comparative round fibers and was of equal denier. Both ropes were subjected to a spindle abrasion test on a Ueshima Belt Flex Ester FT-401. The ropes were tested in 40-cm (16-inch) lengths simultaneously in four positions on the test machine. The ropes were cycled (reciprocated) over a single pulley at an angle of 180 degrees at a rate of 100 cycles per minute. The number of cycles to failure were measured under a load of 70 kg. The results were as follows:

TABLE 1

| Abrasion to Failure - Hexagonal Fiber Rope vs Round Fiber Rope 3-Strand PET Ropes, Equal denier, Break Strength about 1800 lbs 100 cycles/min, 70 kg wt, 4 mm spindle groove, 32 mm spindle diam. | | | | |
|---|---|---|---|---|
| | Position | Cycles-to Failure | | |
| | 2 | 3 | 4 | 5 |
| Hexagonal Fiber Rope | 22742 | 49331 | 51166 | 28700 |
| Round Fiber Rope | 23522 | 38452 | 22692 | 17524 |

The data show the superior abrasion resistance of the hexagonal fiber rope.

EXAMPLE 6

Yarn Preparation

A poly(p-phenylene terephthalamide) polymer of 5.6 intrinsic viscosity (IV) is added over a period of several minutes to frozen sulfuric acid snow (100.05% $H_2SO_4$) at −10° C. to −15° C. through a top entrance of a fluid jacketed Model 4CV Helicone Mixer manufactured by Atlantic Research Corporation, equipped with an exit gear pump. The ratio of the mixture is 19.7 g polymer to 80.3 g $H_2SO_4$. The mixture is sealed and the mixing blades started. The temperature of the fluid jacket is increased to about 71° C. over a period of about 1.5 hours. The temperature is then brought to 80° C. and mixing continued for about 0.5 hour. Mixing is then stopped and the polymer solution is degassed under vacuum for about 1.5 hours. The hot polymer solution is pumped from the mixer through a transfer line closely wrapped with a hot water line (80° C.–90° C.) to an electrically heated (80° C.) spinning block and attached gear pump. The gear pump meters the polymer solution through another passage in the block to an electrically heated (75° C.–80° C.) spinneret pack containing a backing screen, distributing screen, filtering medium and a 2.5 cm (1.0 inch) diameter spinneret containing 40 orifices having the geometry shown in FIGS. 1*a* and 1*b*. The polymer solution is extruded from the spinneret downward through an 0.47 cm (3/16 inch) gap of air into a constantly replenished cold (0° C.–5° C.) water bath having an attached vertical spin tube [1.9 cm (0.75 inch) I.D. with an entry constriction of 0.63 cm (0.25 inch) I.D.; 30 cm (12 inches) length] which extends into the bath to 3.18 cm (1.25 inches) from the water surface. The coagulated extrudate passes through the 3.18 cm (1.25 inches) of water and then enters the spin tube along with a portion of the cold water bath. The quenched thread line containing less than 50% acid is then directed over two polished ceramic pins [0.47 cm (3/16 inch) diameter, spaced on 1.6 cm (5/8 inch) centers] placed immediately below and in-line with the spin tube exit. The angle ("snub angle") of the thread line passing between the pins makes with its projected path in the absence of the pins is varied by the relative position of the two ceramic pins. The yarn then passes under a ceramic rod about 62 cm (25 inches) from the spin tube to direct the thread line to three successive sets of wash/neutralization rolls. Thread line tension is measured between this rod and the first set of rolls using a hand-held tensiometer. The yarn then travels 75 cm (30 inches) from the ceramic rod to the first set of wash rolls on which the yarn is sprayed with water to remove nearly all sulfuric acid. On the second set of rolls, the yarn is sprayed with dilute (0.5%) NaOH to neutralize any residual $H_2SO_4$. Finally, on the third set of rolls the yarn is sprayed again with water to remove salts. The purified yarn is wound up and dried on the bobbin at room temperature.

The cross-sections of the filaments comprising the yarn prepared according to the method described above are substantially hexagonal in shape.

EXAMPLE 7

Rope Properties

Two ropes are constructed, one consisting of the hexagonal poly(p-phenylene terephthalamide) fibers of the invention prepared as in Example 6, and one consisting of the prior art round fibers, similarly prepared. The ropes are subjected to a spindle abrasion test on a Ueshima Belt Flex Tester FT-401. The ropes are tested in 40 cm (16 inch) lengths simultaneously in four positions on the test machine. The ropes are cycled (reciprocated) over a single pulley at an angle of 180 degrees at a rate of 100 cycles per minute and the number of cycles to failure are measured. It is found that the rope consisting of the hexagonal fibers of the invention has a resistance to abrasion superior to that of the round fiber rope.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and the foregoing description without departing from the substance or scope of the present invention.

Accordingly, while the present invention has been described in detail in relation to its preferred embodiments, it is to be understood that this disclosure is only illustrative and exemplary of the present invention and is made merely for purposes of providing a full and enabling disclosure of the invention. The foregoing disclosure is not intended to be construed to limit the present invention or otherwise exclude any other embodiments, adaptations, variations, modifications or equivalent arrangements, the present invention being limited only by the claims and the equivalents thereof.

What is claimed is:

1. A multi-filament article comprising:

a plurality of filaments, each filament having an equivalent diameter between 0.01 mm and 0.06 mm and being generally hexagonal in cross-section with substantially planar faces extending longitudinally, said filaments being arranged to extend longitudinally in parallel with one another along an article axis with adjacent filaments having adjacent faces in abutment with one another.

2. The multi-filament article according to claim 1 wherein each filament is formed from a polymer selected from the group consisting of polyesters, polycarbonamides, polyamides, polyaramids, polyolefins, polybenzazoles polyketones, polyethers and vinyl polymers.

3. The multi-filament article according to claim 1 wherein the filaments are formed from polyethylene terephthalate.

4. The multi-filament article according to claim 1 wherein the filaments are formed from polyamide.

5. The multi-filament article according to claim 1 wherein the filaments are formed from polyolefin.

6. The multi-filament article according to claim 1 wherein the filaments are formed from aramid.

7. The multi-filament article according to claim 1 wherein the filaments are formed from polybenzoxazole or polybenzothiazole.

* * * * *